United States Patent [19]

Fischer

[11] 4,000,395

[45] Dec. 28, 1976

[54] THERMAL CUTTING APPARATUS

[76] Inventor: Artur Fischer, Altheimer Strasse 219, 7241 Tumlingen, Germany

[22] Filed: Nov. 11, 1974

[21] Appl. No.: 522,931

[30] Foreign Application Priority Data

Nov. 17, 1973 Germany ..... 2357527

[52] U.S. Cl. ..... 219/221; 30/116; 30/140; 83/171; 219/233; 219/533; 225/93.5

[51] Int. Cl.[2] ..... H05B 1/00; B26D 7/10; B26F 3/12

[58] Field of Search ..... 219/233, 236, 238, 270, 219/549, 552, 553, 221, 227, 533; 338/214; 83/1, 13, 16, 170, 171; 264/321; 317/98; 30/140, 116, 117; 225/93.5

[56] References Cited

UNITED STATES PATENTS

| | | | |
|---|---|---|---|
| 1,130,373 | 3/1915 | Bright | 225/93.5 |
| 2,464,718 | 3/1949 | Potter et al. | 83/13 |
| 2,476,680 | 7/1949 | Morgard | 225/93.5 |
| 2,546,164 | 3/1951 | Norris | 219/553 |
| 2,655,960 | 10/1953 | Murray | 83/171 X |
| 2,677,747 | 5/1954 | Jaye | 83/16 |
| 2,692,328 | 10/1954 | Jaye | 83/170 |
| 2,896,059 | 7/1959 | Ruff | 30/140 |
| 3,199,388 | 8/1965 | Redfield | 83/16 |
| 3,344,392 | 9/1967 | Briscoe | 219/549 X |
| 3,526,750 | 9/1970 | Siegel | 219/233 |
| 3,587,377 | 6/1971 | Olson et al. | 83/171 |
| 3,610,078 | 10/1971 | Rowlands | 83/1 |

*Primary Examiner*—A. Bartis
*Attorney, Agent, or Firm*—Michael J. Striker

[57] ABSTRACT

An apparatus for cutting arbitrary shapes in material, particularly in synthetic plastic foam material, is disclosed. The apparatus includes a bendable, shape-retaining, electrically conductive resitive wire which may be successively formed into any desired shape by selectively arranging either or both elements of a pair of independently movable wire positioning elements which are respectively attached to end portions of the resistive wire. The resistive wire is also connected to an electrical current source provided on said elements for heating the wire to a predetermined temperature which is sufficiently high so that the wire may cut the desired shape into the workpiece by heat. Securing portions are provided on the independently movable elements so that the latter may be secured together and form an interlocked assembly so that the resistive wire may be fixedly positioned into a loop, threby permitting identical shapes and circular patterns to be cut into a series of workpieces by mass-production techniques.

11 Claims, 2 Drawing Figures

THERMAL CUTTING APPARATUS

BACKGROUND OF THE INVENTION

The present invention relates to an apparatus for and method of cutting arbitrary shapes into material, and more particularly to cutting arbitrary shapes into synthetic plastic foam material.

In the prior art, it is known to heat resistive wire, such as "Constantan," by passing sufficient current through the resistive wire so that the wire will be heated to temperatures in the range of 200° C through 300° C to thereby efficiently cut synthetic plastic foam material, such as styrofoam. The cutting apparatus of the prior art, however, had the disadvantage of only being capable of cutting straight line patterns. It is known in the prior art to extend the wire between two bracket arms and to fixedly fasten the arms to a stationary jig while the synthetic plastic foam material was guided towards the extended wire. Alternatively, it is known in the prior art to keep the synthetic plastic foam material stationary and to move the wire relative to the synthetic plastic foam material.

In both situations, the cutting devices of the prior art are limited to cutting linear patterns and consequently have the disadvantage of not being able to cut curvilinear patterns or any closed line patterns, such as circles or bore holes.

In other words, the prior art is severely limited with respect to the kinds of shapes that can be cut as well as the various uses to which the foam shapes can be employed. For example, in modeling applications where it is desired to create landscaping scenes, the capability of only being able to cut horizontal or vertical lines makes it extremely difficult to present a true-to-life setting.

SUMMARY OF THE INVENTION

Accordingly, it is the general object of the present invention to overcome the disadvantages of the prior art.

More particularly, it is an object of the present invention to provide an apparatus which can be positioned so as to successively cut arbitrarily shaped pieces into synthetic plastic foam material.

Another object of the present invention is to provide an improved method for cutting arbitrary shapes into a material by heat.

A further object of the present invention is to provide an apparatus which can fixedly position a cutting wire into a loop so that identical shapes may be cut into a series of workpieces by mass-production techniques.

In keeping with these objects, and others which will become apparent hereinafter, one feature of the present invention is the independent movability of a pair of wire-positioning elements, each of which is connected to end portions of a bendable, shape-retaining resistive wire. By thereby positioning either or both elements of the pair of wire-positioning elements, the resistive wire can be bent to and maintained in any desired shape. For example, by bending the wire into a curved shape, grooves or any curvilinear pattern may be cut. Of course, it is also possible to cut straight line patterns by fully extending the wire-positioning elements into a vertical or a horizontal orientation. by combining the cutting apparatus with a feeding device which is capable of changing direction, such as a conveyor belt, unlimited curvilinear and linear shapes are achieved.

Another feature of the present invention is that the cutting is achieved by heating the resistive wire to elevated temperatures in a range from 200° C through 300° C, so that the synthetic plastic foam material is cut so quickly that the material to be cut does not lose its rigidity in the process of being cut, and that therefore any groove or bore hole may be created without collapse of the material itself. In other words, no additional trimming of the bore holes is necessary, as is common in the prior art, due to the collapse of the material around the circumferential edge of a pattern cut.

Another feature of the present invention is to provide releasable supporting clamps, each respectively connected to end portions of the resistive wire and clampable to each of the movable elements. Should it ever be desired to change a resistive wire, then the clamps would permit such a substitution without disturbing the orientation of the wire-positioning elements--an especial advantage in mass-production lines.

Another feature of the present invention is to provide that each wire-positioning element has a securing portion, each of which can cooperate with and be respectively secured to the other, thus forming an interlocked but releasable assembly. In this manner, all pieces which are to be consecutively cut along an assembly line will be substantially identical in shape. For example, by securing the wire-positioning elements to each other in an interlocked assembly, the wire may be fixed in a looped position. By turning the wire-positioning elements in a rotary motion, it will be possible to cut a circular pattern into a workpiece by engaging the bight portion of the shape-retaining wire substantially perpendicularly to the synthetic plastic foam material. Of course, different diameters of circular patterns may be achieved by varying the size of the bight portion of the loop.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
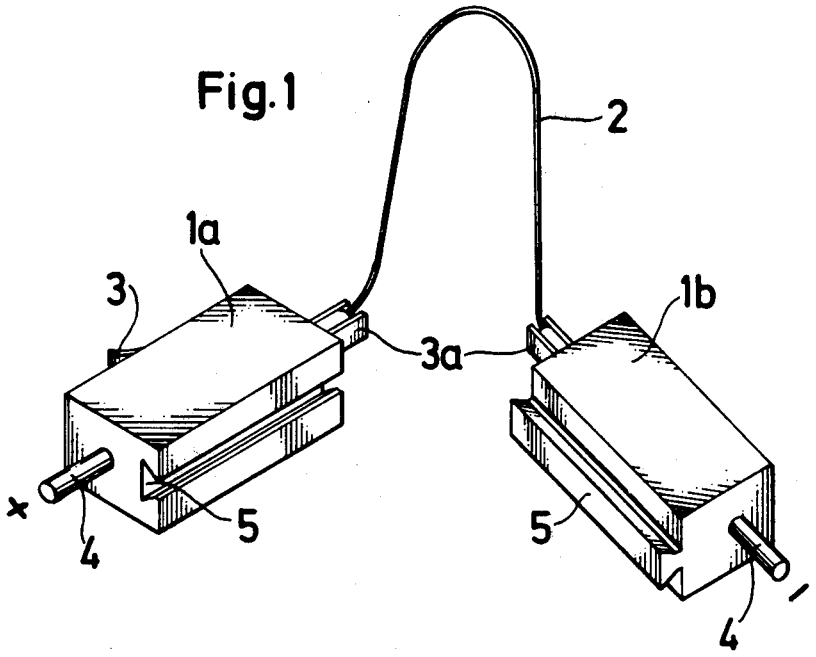
FIG. 1 is a perspective view of a cutting apparatus according to the present invention showing the wire positioned in an arbitrary shape.
Figure 2:
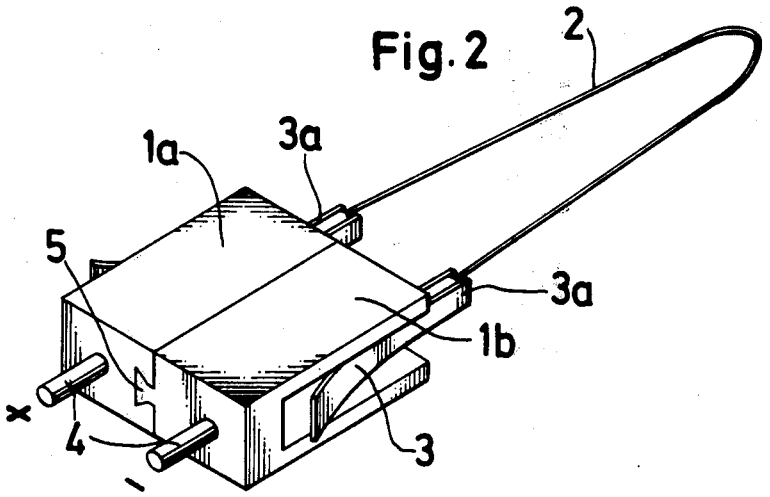
FIG. 2 is a perspective view of a cutting apparatus according to the present invention showing the wire-positioning elements secured to each other.

Discussing jointly the apparatus and the method which have been illustrated in an exemplary embodiment in FIGS. 1 and 2, it will be seen that reference numerals 1a and 1b identify respectively the independently, electrically non-conductive, movable wire-positioning elements, each of which is respectively connected to the bendable shape-retaining resistive wire 2, so that the resistive wire may be bent and positioned by moving the elements 1*a* and 1*b*. The term "bendable shape-retaining" wire is intended to mean a wire which is selectively bendable into various configurations for cutting different shapes and which is also stiff enough as to retain the selected configuration into which it has been bent until subsequently rebent to form a different configuration.

The resistive wire 2 is supported by an electrically connected to the support clamps 3. The free ends of the support clamps 3 overhang the wire-positioning elements 1*a*, 1*b*. At each end portion of the wire 2, current-carrying wires 4 which are connected to the clamps 3 conduct current to the wire 2 from an electrical current source (not illustrated).

The wire-positioning elements 1*a*, 1*b* may be secured to each other, so as to prevent one from moving with respect to the other. The elements 1*a* 1*b* have securing portions 5 which cooperate with each other so as to form an interlocked but releasable assembly. For example, one cooperating portion 5 on element 1*b* is shown to be a V-shaped projection, and the cooperating portion 5 on element 1a is depicted as a V-shaped recess. It will be appreciated that each of the securing portions 5 may be alternatively located on the other element and not thereby detract from the spirit of the present invention.

In the operation as depicted in FIG. 1, the pair of wire-positioning elements 1*a*, 1*b* are each independently movable with respect to each other, that is element 1a is movable with respect to element 1*b*, and vice versa. Alternatively, it is also within the intended operation of the present invention that either element 1*a* or 1*b* be fixedly located while the other element is independently movable.

By selectively positioning either or both of the independently-movable elements 1*a*, 1*b* which are respectively attached to end portions of the resistive wire 2, the resistive wire 2 can be bent and positioned into any desired shape by its shape-retaining feature. The cutting of the workpiece itself is achieved by heating the resistive wire 2 to a sufficiently elevated temperature by means of the current wires 4 so that the workpiece will melt when the resistive wire 2 engages the workpiece.

In the operation as depicted in FIG. 2, the wire-positioning elements 1*a* and 1*b* are fixedly secured with respect to each other by the cooperating securing portions 5. The projecting portion found on one of the elements, element 1b for example is slidably inserted into a cooperating recess on the element 1*a*. By designing the projection and the recess to be of V-shaped configuration, it will be seen that outward movement is prevented by the abutting lateral edges of the mating pieces. The supporting clamps 3 are clamped to each of said independently-movable elements 1*a*, 1*b*, so as to provide for the release of the resistive wire 2 should a substitution of the wire 2 become necessary during the course of a mass-production run.

It will be understood that any resistive wire having a relatively stiff but bendable shape-retaining characteristic can be employed; for example "Constantan" may be employed and may be heated to a predetermined temperature range from about 200° C to 300° C.

The wire-positioning elements 1*a*, 1*b* may be made from any insulating material, such as synthetic plastic which will not deform when subjected to electrical current or temperatures greater than the range disclosed.

The device as shown in FIG.2 is especially useful for cutting circular patterns into a workpiece. Since the two wire-positioning elements 1*a*, 1*b* are both fixed with respect to each other, they thereby form a wire in the shape of a loop. The looped wire has a bight portion which can be engaged to a workpiece in a substantially perpendicular manner. Thereupon, by turning the elements 1*a*, 1*b* together in a rotary motion, it will be possible to cut a circular closed pattern into a workpiece.

The operation as disclosed in FIG. 1 is particularly suitable for cutting any curvilinear pattern into a workpiece. Alternatively, by extending the two wire-positioning elements 1*a*, 1*b* longitudinally of each other so as to straighten the cutting wire 2 into an extended position, it will be possible to cut straight line or angular shapes as well.

It will be understood that each of the elements described above, or two or more together, may also find a useful application in other types of constructions differing from the type described above.

While the invention as been illustrated and described as embodied in a method and apparatus for cutting, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art fairly constitute the essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A cutting apparatus for cutting shapes in workpieces, particularly synthetic plastic foam material, comprising an electrically-conductive, resistive wire having spaced end portions and being bendable to form a desired workpiece-cutting configuration but being stiff enough to retain the wire in said configuration to which it has been bent; means for changing the shape of said resistive wire, including a pair of independently-movable, electrically nonconductive, wire-positioning elements, each of which is connected to one of said end portions; means for releasably interlocking said wire-positioning elements together in linear sliding relationship so that said resistive wire may assume a plurality of said predetermined configurations; and means for supplying electrical current provided on at least one of said elements and connected with said resistive wire for supplying heating current to said wire for heating said wire to a predetermined temperature, whereby said heated wire may be successively bent and positioned by moving said elements to form it into shapes requisite for cutting different shapes into a workpiece.

2. A cutting apparatus as defined in claim 1, wherein said wire is constantan heated to a predetermined temperature range from about 200° C to about 300° C; and wherein said material to be cut is styrofoam.

3. A cutting apparatus as defined in claim 1, wherein said pair of wire-positioning elements are formed of insulating material, and wherein one element of said pair is stationary and said other element is linearly movable relative thereto.

4. A cutting apparatus as defined in claim 1, wherein said connecting means comprises securing portions, each securing portion cooperating with the other so as to form an interlocked assembly.

5. A cutting apparatus as defined in claim 4, wherein one of said securing portions comprises a projection and the other of said securing portions comprises a recess, said projection being receivable in said recess so as to form of said securing portions an interlocked assembly, whereby said wire may be shaped into a loop so as to cut closed curvilinear patterns into a workpiece.

6. A cutting apparatus as defined in claim 1, wherein said current supplying means includes a releasable clamp on each of said wire-positioning elements for supporting the resistive wire and for supplying electrical current thereto.

7. A cutting apparatus as defined in claim 1, wherein said wire-positioning elements are movable relative to one another so as to bend said wire into a curvilinear pattern.

8. A cutting apparatus as defined in claim 1, wherein said wire-positioning elements are movable relative to one another so as to bend said wire into an angular pattern.

9. A cutting apparatus as defined in claim 1, wherein said connecting means comprises undercut portions elongated lengthwise of said elements so as to facilitate back-and-forth movement of the latter in the direction of the elongation of said undercut portions.

10. A cutting apparatus for cutting shapes in workpieces, particularly synthetic plastic foam material, comprising an electrically-conductive, resistive wire having spaced end portions and being bendable to form a desired workpiececutting configuration but being stiff enough to retain the wire in said configuration to which it has been bent; means for changing the shape of said resistive wire, including a pair of independently movable, electrically-nonconductive, wire-positioning elements, each of which is connected to one of said end portions; means for connecting said wire-positioning elements together in a position in which said resistive wire assumes a predetermined configuration, said connecting means comprising securing portions which cooperate with each other so as to form an interlocked assembly, one of said securing portions being a projection and the other of said securing portions being a recess which receives said projection, said projection and said recess being elongated and extending over the entire length of said wire-positioning elements so as to facilitate linear back-and-forth movement of the latter in the direction of the elongation of said projection and said recess; and means for supplying electrical current provided on at least one of said elements and connected with said resistive wire for supply heating current to said wire for heating said wire to a predetermined temperature, whereby said heated wire may be successively bent and positioned by moving said elements to form it into shapes requisite for cutting different shapes into a workpiece.

11. A cutting apparatus for cutting shapes in workpieces, particularly synthetic plastic foam material, comprising an electrically conductive resistive wire having spaced end portions and being bendable to form a desired workpiece-cutting configuration but being stiff enough to retain the wire in said configuration to which it has been bent; a pair of indenpendently-movable, electrically non-conductive, wire-positioning elements movable relative to one another so as to bend said wire into a curvilinear pattern, each of said wire-positioning elements being connected to one of said end portions of said resistive wire by releasable support clamps on the positioning elements, each of said wire-positioning elements further including movable securing portions in releasable interlocked linear sliding relationship with each other, one of said securing portions comprising a projection and the other of said securing portions comprising a recess, said projection being receivable for sliding movement in said recess; and means for supplying electrical current provided on at least one of said elements and connected by said releasable support clamps with said resistive wire for supplying heating current to said wire for heating said wire to a predetermined temperature, whereby said heated wire may be successively bent and shaped into a loop by moving said elements so as to cut curvilinear patterns into a workpiece.

* * * * *